US005271253A

United States Patent [19]

Cassada et al.

[11] Patent Number: 5,271,253

[45] Date of Patent: Dec. 21, 1993

[54] ELECTRONIC COMBINATION LOCK WITH MAGNETIC ANTI-ATTACK INTERLOCK

[75] Inventors: Thomas E. Cassada; Gerald L. Dawson, both of Lexington, Ky.

[73] Assignee: Mas-Hamilton Group, Lexington, Ky.

[21] Appl. No.: 851,511

[22] Filed: Mar. 16, 1992

[51] Int. Cl.[5] ..... E05B 47/00

[52] U.S. Cl. ..... 70/276; 70/333 R; 70/1.7; 70/150; 292/251.5

[58] Field of Search ..... 70/276, 413, 303 A, 70/333 R, 1.5, 1.7, 277, 150; 292/251.5

[56] References Cited

U.S. PATENT DOCUMENTS

| | | | |
|---|---|---|---|
| 1,172,203 | 2/1916 | Fuller . | |
| 2,121,301 | 6/1938 | Ractcliffe | 70/276 |
| 2,925,726 | 2/1960 | Miller | 70/1.5 |
| 2,966,789 | 1/1961 | Hall | 70/276 |
| 3,393,541 | 7/1968 | Wake | 70/276 |
| 3,512,382 | 5/1970 | Check | 70/276 |
| 3,518,855 | 7/1970 | Wake | 70/276 |
| 3,566,637 | 3/1971 | Hallmann | 70/276 |
| 3,584,484 | 6/1971 | Hallmann et al. | 70/276 |
| 3,665,740 | 5/1972 | Taniyama | 70/276 |
| 3,684,292 | 8/1972 | Penrod et al. | 273/156 |
| 3,744,833 | 7/1973 | Berducone | 292/251.5 |
| 4,073,166 | 2/1978 | Clark | 70/394 |
| 4,380,162 | 4/1983 | Woolfson | 70/276 |
| 4,654,782 | 4/1972 | Heimann | 70/276 |
| 4,745,784 | 5/1988 | Gartner | 70/277 |
| 4,831,851 | 5/1989 | Larson | 70/277 |
| 4,848,812 | 7/1989 | Slaughter | 292/251.5 |
| 5,029,912 | 7/1991 | Gotanda | 292/251.5 |

FOREIGN PATENT DOCUMENTS

| | | | |
|---|---|---|---|
| 2406547 | 6/1979 | France | 70/276 |

*Primary Examiner*—Peter M. Cuomo
*Assistant Examiner*—Darnell M. Boucher
*Attorney, Agent, or Firm*—Laurence R. Letson

[57] ABSTRACT

To prevent the opening of an electronic combination lock by using a strong magnet to operate a stepper motor, a magnetic interlock is included in the lock structure. A magnetic pin is held in a retracted position by a small magnet when a strong attack magnet is positioned to attempt to open the lock, the magnetic pin is attracted from the holding magnet and extended to bridge the bolt and lock housing, blocking the retraction of the bolt.

11 Claims, 2 Drawing Sheets

ELECTRONIC COMBINATION LOCK WITH MAGNETIC ANTI-ATTACK INTERLOCK

RELATED APPLICATIONS

This application is an improvement of the lock disclosed, described and claimed in co-pending patent application Ser. No. 719,046, filed Jun. 21, 1991, entitled "Electronic Combination Lock With High Security Features", by Gerald L. Dawson et al., and commonly assigned with this application.

FIELD OF THE INVENTION

This invention relates to bolt locks and, more specifically, to electronically operated bolt locks having an electrically actuable electromagnetic means to enable the lock to be operated.

BACKGROUND OF THE INVENTION

Some electronic locks have devices contained therein which are controllable electrically and electromagnetic in nature which enable an external force applied through a lever or knob to be connected to the bolt for purposes of retracting the bolt and causing the lock to open. One such lock is described in U.S. patent application Ser. No. 719,046, filed Jun. 21, 1991, entitled "Electronic Combination Lock With High Security Feature", by Gerald L. Dawson et al. Because locks of this type have electromagnetic enabling devices included in their design, and magnetic flux fields can penetrate lock materials to permeate the inner cavity of the lock housing, very strong magnets may be used to attack the lock. The magnetic field can cause the electromagnetic enabling device to operate and render the lock capable of unauthorized operation.

If such a strong magnet is used to attack the lock, the magnetic flux from the magnet may act upon the movable portion of the electromagnetic device, such as an armature of a solenoid or stepper motor, to cause the device to act as if it had been electronically operated by a signal generated by the electronic controls of the lock upon receipt of an authorized combination. An example of this would be the displacement of an armature in a solenoid or the rotation of the armature of a stepper motor Both of the armatures are affected by magnetism which is normally generated by an electrical current passing through a coil in proximity to a displaceable armature member. The displacement of the armature may be accomplished by an external magnetic field if the field is of sufficient strength and proper polarity.

It is a well known technique to position shielding around devices which may be adversely affected by magnetic flux. The typical shielding is an enclosure of steel or other magnetically permeable material which will provide a desired or least resistance path for the magnetic flux and concentrate the magnetic flux in the shield structure, thereby reducing flux densities in adjacent regions. By reducing the flux density surrounding the shield, magnetic manipulations of mechanisms or parts may be reduced or prevented. However, with a sufficiently strong magnetic field, shielding may be helpful but may not be totally effective. High flux densities surrounding very strong magnets can provide a magnetic field which can overcome the shielding effects in a device such as a lock mechanism.

Since the shielding of elements within the lock mechanism may not be totally effective when attacked by a very strong magnet, it then becomes imperative to prevent the lock bolt from being withdrawn and the lock opened should the lock be attacked by a strong magnet. Any shielding which has been placed about the elements of the lock mechanism, such as a stepper motor or solenoid, may fail and not prevent operation of the lock by the attack magnet. The security of the lock under magnetic attack must be assured by other means It is to this end that the subject invention is addressed in order to prevent the displacement of the bolt of the lock from an extended position to a retracted position.

Locks which utilize an electromagnetic device to enable the lock to function upon receipt of an electrical signal from the electronic controls, such as that described in U.S. Pat. No. 5,061,923, to James C. Miller et al., may be attacked by a strong magnet. Typically, the mode of attack is to place the magnet on the outside of the lock housing thereby shifting the displaceable element of the electromagnetic enabling device to a position where the lock cannot be securely locked and the mechanism can be opened without an authorized combination. To attack the lock, after placing the magnet in its appropriate position on the lock housing, the unauthorized individual waits for the authorized individual to close and "lock" the lock mechanism. The authorized individual when locking the device is unaware that a small but powerful magnet has been positioned on and attached to the mechanism of the lock housing and, accordingly, the authorized individual believes that the lock has been operated to be secure. The flux field of the magnet has prevented the lock mechanism from becoming secure when the container is closed. At a later time, the unauthorized individual returns to open the container without the benefit of an authorized combination by merely manipulating the knob or lever to withdraw the bolt, as if the proper combination was entered and the electromagnetic enabling device actuated by the lock controls.

SUMMARY OF THE INVENTION

It is an object of the invention to prevent unauthorized operation of the electronic lock by magnetic attack.

It is another object of the invention to prevent displacement of the lock bolt when external magnetic fields are applied to the lock mechanism.

An interlocking pin, which may be contained in the bolt to extend between the bolt of the lock mechanism and the lock housing, is normally held in a withdrawn or detented position within the bolt of the lock by a small magnet inserted into a recess or hole drilled into the bolt. The hole/recess drilled into the bolt may be inclined from the perpendicular to the bolt surface into which the hole/recess is drilled in such a direction that when under magnetic influence the pin extends from that hole/recess and bridges the interface between the bolt and the lock housing, any attempt to open the lock will result in a shearing action across the pin in a plane which is not perpendicular to the axis of the interlock pin. A small magnet of a material having a very high coercive force is placed during manufacture in the hole/recess in the bolt to hold the interlock pin in a retracted position under all conditions where a strong magnetic field is not applied to the lock mechanism. The lock housing is similarly provided with such a recess/hole which is or may become aligned with and coaxial with the recess/hole in the bolt when the bolt is in the extended position Within this lock housing recess/hole is inserted a highly magnetically permeable material. The exposed face of the insert is formed to be parallel with the slide surface of the lock housing.

Partially surrounding the stepper motor or electromagnetic enabling device is a magnetic shield. The magnetic shield serves two functions; the first being the shielding of the stepper motor or electromagnetic enabling device from an external magnetic field, and the second being a concentrator of the flux from the externally applied magnetic field to route or focus the flux at a point where it can be used to attract the interlock pin to bridge between the bolt and the lock housing.

Whenever the lock is attacked or affected by a strong magnetic field, the shielding will tend to prevent significant quantities of magnetic flux from affecting either the armature of the stepper motor or the armature of the solenoid and may effectively prevent the unauthorized operation of the lock. However, if sufficient magnetic flux is present to affect the electromagnetic enabling device within the lock, the magnetic field will also act to form temporary or transitory magnets of the insert and pin, attracting the pin from its retracted position to an extended position, thereby bridging the bolt and the lock housing. The magnetic holding or detenting force of the small magnet which is placed within the hole/recess in the bolt is overcome by the significantly stronger magnetic field of the attack magnet; once overcome and imbalanced, the interlock pin will slide or translate to its extended position. The extension of the pin across the small gap between bolt and housing will prevent the bolt from being withdrawn into housing and effectively interlocks the combination lock as long as the attack magnet is positioned to operate the stepper motor.

The magnet within the bolt is made from a material having a very high coercive force to prevent it from reversing polarity when influenced by the magnetic field of the attack magnet. Accordingly, when the attack magnet is removed from proximity to the lock, the small magnet within the bolt will re-attract the interlocking pin and thus return the lock to a condition where it can operated whenever an appropriate and authorized combination is entered.

DRAWINGS

Figure 4:
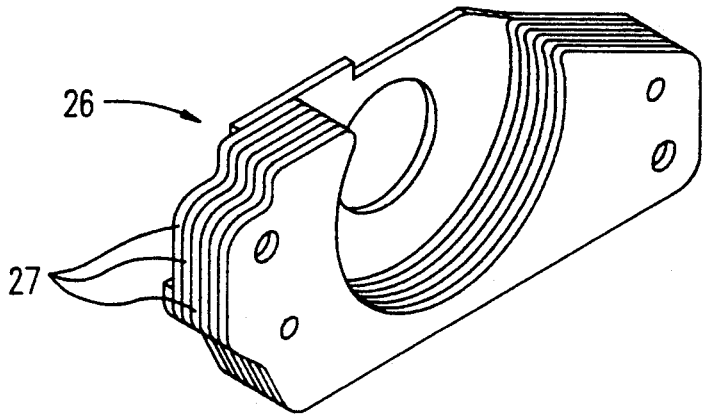

FIG. 4 a rear perspective of the stepper motor shield illustrating its construction.

A better understanding of the invention may be had by referring to the drawings and the detailed description which follows.

DETAILED DESCRIPTION OF THE BEST MODE CONTEMPLATED FOR CARRYING OUT THE INVENTION

Figure 1:
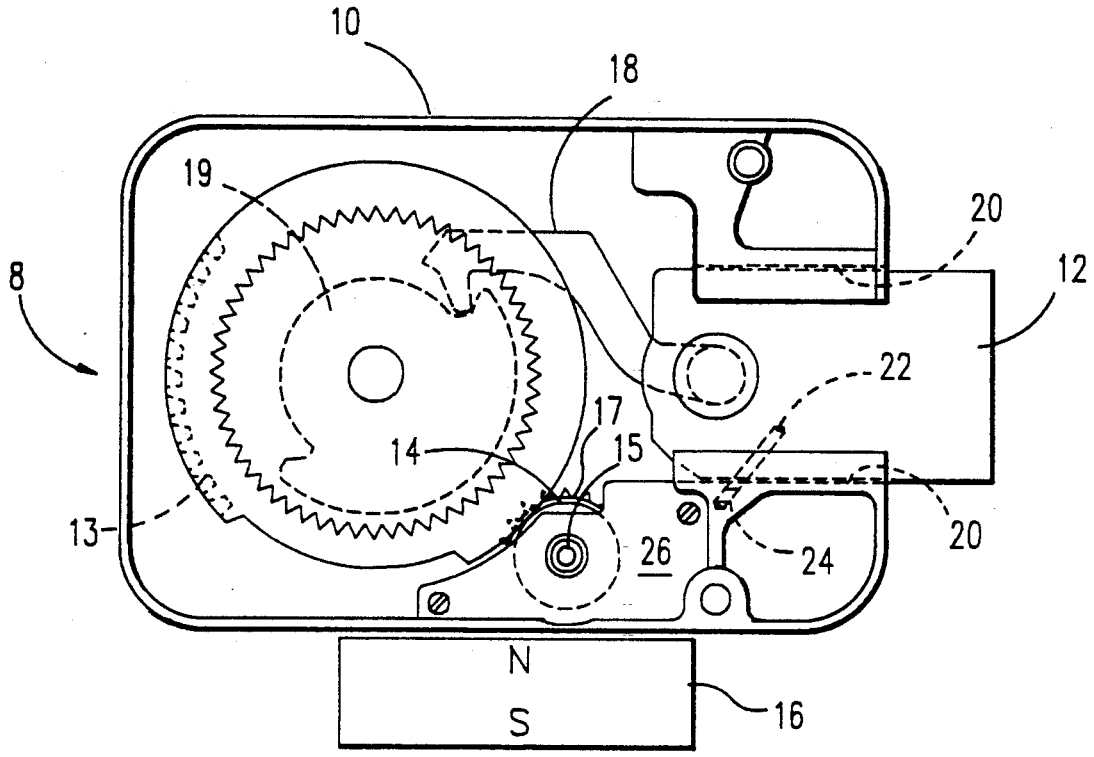
FIG 1 is a representation of the lock housing with the shielding and the interlock mechanism installed within the lock housing and having an attack magnet positioned in close proximity thereto.
Figure 2:
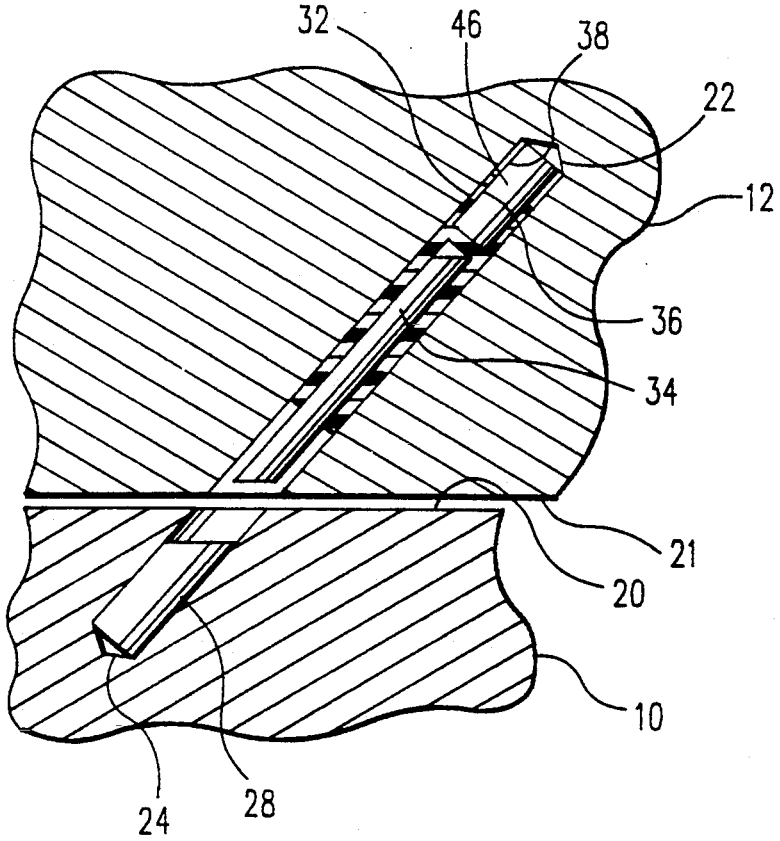
FIG. 2 is an enlargement of the portion of the lock housing and bolt containing the interlock mechanism.

Referring first to FIGS. 1 and 2, which illustrates a substantial portion of the lock mechanism as may be more fully and thoroughly understood by reference to U.S. patent application Ser. No. 839,174 entitled "Anti-Attack Interlocks For A Combination Lock Mechanism", filed Feb. 20, 1992, by Gerald L. Dawson et al., and commonly assigned herewith.

Lock housing 10 is provided to support and contain the mechanism of the lock 8. Housing 10 is further provided with slide-way surfaces 20 which support and constrain bolt 12 for reciprocal movement between an extended position, as illustrated, and a withdrawn position. Whereby, the bolt 12 is withdrawn into the lock to disengage the jamb at a container secured by the lock.

Lever 18, attached to bolt 12, provides the mechanism by which the lock retractor 19 may be coupled with the bolt 12 to withdraw the bolt 12 from its extended position as more fully explained in co-pending application Ser. No. 839,174, filed Feb. 20, 1992, entitled "Anti-Attack Interlocks For A Combination Lock Mechanism", by Gerald L. Dawson et al. Stepper motor 14, the electromagnetic enabling device, is operable upon receipt of an electrical signal from the electronics of the lock 8 to rotate its armature and shaft 15 a partial revolution. The shaft positions a partial gear 17 such that the gear 17 may be engaged by a partial gear 13 mounted on the input shaft of the lock 8. These parts are not illustrated herein in detail but are found and described in co-pending United States Patent Application by Gerald L. Dawson et al., identified immediately above. However, reference to the co-pending application is made for a complete understanding of the environment which the present invention is useful.

Hole/recess 22 is formed into the bolt 12 and is preferably formed by drilling. The angle of hole/recess 22 is preferably as shown to present a larger cross-section of the interlock pin 34, to be described later, at the interface between bolt 12 and housing 10 at the slide-way surface 20. Similarly and identically oriented, a hole/recess 24 is formed into the lock housing 10. The elements of the interlock, to be described below, are then inserted into the respective holes/recesses 22 and 24.

A shield 26 surrounding stepper motor 14 is positioned within lock housing 10. The stepper motor 14 is substantially surrounded by shield 26. Shield 26 is formed by laminating multiple layers 27 of steel to form a stack of plates 27 or layers 27 which build up necessary thickness to extend completely along the length of the stepper motor 14 in its axial direction.

This shield 26 extends away from stepper motor 14 into proximity with recess/hole 24 to direct and focus the flux applied to stepper motor 14 in a region close to recess/hole 24. Attack magnet 16 is illustrated positioned on the outside of the housing 10 thereby permeating, with a flux field, the area within lock housing 10.

Referring now to FIG. 2, which is an enlargement of a section through bolt 12 and lock housing 10 together with the elements of the interlock, recess/hole 22 is shown as a drilled hole having a generally conical shaped end. The hole is oriented at a preferred angle of approximately 45 degrees from the edge surface of the bolt 12 into which it is drilled. Coaxial with the axis of recess/hole 22 is recess/hole 24 which is in turn drilled into the lock housing 10. The angle is not critical but typically determined design of the lock and the orientation of the attack magnet 16. It may be perpendicular in a design where the flux can be focused in the proper orientation. Other angles are also operable, and may be used.

The requirement of recess/hole 22 being coaxial with recess/hole 24 need only exist at some time during the attempted retraction of bolt 12. The movement of bolt 12 may move the recess/hole 22 into a coaxial position with recess/hole 24. With the recesses/holes 22, 24 misaligned in the locked condition, if pin 34 is extended by an external force, such as an impact, the pin will not extend into the recess/hole 24 with the possibility of being frictionally retained. If the pin 34 is frictionally retained, the interlock would prevent the lock 8 from being operated even with an authorized combination.

An insert sleeve 32, dimensioned to fit within recess/-hole 22 is provided. Insert 32 is further provided with a dividing membrane or spacer 40. The spacer 40 extends across the hollow interior of the insert 32 effectively forming two open-ended chambers having walls 36 and 38. Cylindrical wall 38 may surround magnet 46 which is inserted into the cavity formed by walls 38. Pin 34 is likewise similarly inserted into the cavity formed by wall 36. Pin 34 is provided with one flat surface extending along its entire length to mate with a corresponding flat interior surface formed by wall 36, thereby preventing pin 34 from rotating from its desired orientation. The magnet 46 and insert 32 may be cemented or glued into recess/hole 22.

Figure 3:
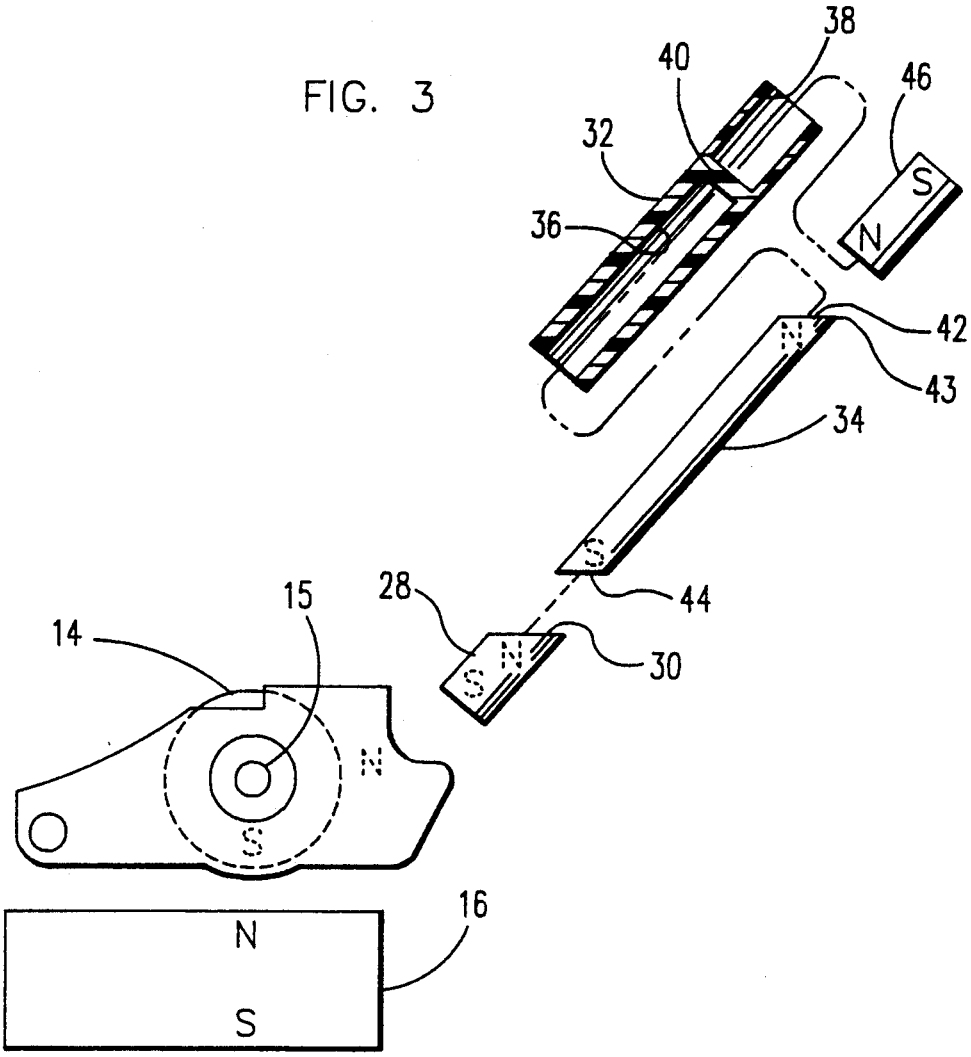
FIG. 3 is an enlarged view of the interlock mechanism without the, lock housing to improve visibility of the individual parts, and illustrating an attack magnet.

Insert 28 is provided with a surface 30 which is substantially parallel to the slide surface 20 of the lock housing 10 and may be cemented or glued into recess/-hole 24. The surface 30 is recessed by a small amount from surface 20 thus leaving a shallow depth hole in the wall of the housing 10. In FIG. 3, the detailed fabrication of the respective elements 28, 34, 32 and 46 are better illustrated.

The ends of pin 34 are provided with surfaces 42 and 44 which, respectively, are parallel to the external surface 21 of bolt 12 when assembled in the bolt. The orientation of end surface 44 allows a deeper penetration of the extending end of pin 34 into recess/hole 24 without significant waste motion of pin 34. From a reliability standpoint, the pin 34 should be extended into the recess/hole 24 sufficiently that an entire cross-section of pin 34 is parallel to surface 21 and the pin extends from the recess/hole 22 into recess/hole 24.

The opposite end surface 42 of pin 34 is similarly oriented. The surface 42 being parallel to surface 44 makes the pin interchangeable with respect to assembly positioning but, more importantly, the angled face 42 reduces the mass of pin 34 in close proximity to magnet 46. Pin 34 fits within the cavity formed by wall 36 of sleeve or insert 32 and the end surface 42, especially the point 43, engages the spacer 40. With the mass of the end of pin 34 closest to magnet 46 reduced, the attractive force, even though sufficient to hold pin 34 in its retracted position, may be much more easily overcome during the attack than if the end was perpendicular to the axis of pin 34 and thus parallel to the end pole of magnet 46. Magnet 46, as indicated by the broken line extending therefrom, is inserted into the chamber defined by wall 38 of insert 32.

Spacer 40 acts to separate the magnet 46 from the end of pin 34 by a fixed distance. The flux density of a magnet typically falls off by a factor of distance to the fourth power for small distances; therefore, by placement of a spacer of known thickness between the magnet and the pin, the magnetic attraction for the pin can be controlled such that the attraction is sufficient to hold the pin in a detented or retracted position within insert 32 and at the same time to provide sufficiently low attraction forces to yield or to be overcome by the attractive force of the attack magnet 16 as it propagates through the shield 26 insert 28 to the pin 34.

The positioning of an attack magnet 16 in proximity of the stepper motor 14, in an effort to cause the stepper motor 14 to position its armature 15 to enable the operation of the lock 8 without the use of an authorized combination, will concentrate the flux field of magnet 16 in shield 26. In doing so, the shield 26 becomes a temporary or transitory magnet and the polarity of the shield 26 will be such that the south pole will be adjacent the wall of the lock housing 10 (not shown in FIG. 3) and the north pole will be more remote and proximate to the insert 28. The result is the temporary magnetization of insert 28 with the south pole being the closer of the two poles to shield 26 and the transitory or temporary north pole being close to the flat surface 20 as shown in FIG. 2. The dash lines used to form the "N" and "S" of each transitory magnet indicate the temporary nature of the magnets.

The continuation of the propagation of the magnetic fields will result in the extendable end surface 42 being the south pole of pin 34. Since the opposite end surface 44 of pin 34 will then be a temporary or transitory north pole, the net affect is that once the attack magnet 16 is placed in a position to operate the stepper motor 14, the two adjacent north poles (one being the end of pin 34 having surface 42 and the other being the adjacent end of magnet 46) will act to repel each other thus, adding a further boost to the force translating pin 34 to extend across surface 21 and 20 and engaging surface 30 of insert 28.

At this point, any attempt to rotate the knob (not shown) and retractor mechanism 19 of the lock 8 to pull lever 18 and thereby to retract bolt 12 will be prevented by pin 34. In order to retract bolt 12 at this point, it would be necessary to completely shear pin 34. The forces required to shear the pin 34 are in excess of that which may be applied to the knob (not shown) by hand and, accordingly, the intruder is prevented from opening the lock 8 without the authorized combination.

Referring now to FIG. 4, shield 26 is formed of several laminates 27 of steel which are, in turn, attached to each other. This plurality of laminates 27 are then stacked to form the necessary depth to substantially enclose stepper motor 14.

The insert 28, shown best in FIG. 3, is typically manufactured of a very highly magnetically permeable material such as Carpenter HyMu80 Alloy, obtainable from Carpenter Technology Corp., Reading, PA 19612. Pin 34 is likewise fabricated from HyMu80 Alloy while the sleeve may be made of a plastic material such as nylon or other suitable molded plastic which additionally has a low coefficient of friction and slides easily against pin 34. Magnet 46 may be manufactured from magnetic material of high coercive strength, such as Neodymium or Samarium Cobalt. Other materials which have a high coercive force exceeding about 3,440 Oersteds (Hc) may be used. This criteria for a minimum coercive force is determined by the flux density which may be encountered at the gap between pin 34 and insert 28 with the strongest known magnet 16, having a strength of about 3,700 Gauss, being placed on the case. While electromagnets are made which produce a stronger field, they cannot readily be hidden inside a container or safe, because such strong electromagnets require a very large power source. Such a power source and associated structure would expose their presence and accordingly defeat the attempt to defeat the lock 8 in an undetected manner.

By selecting the material for magnet 46 as having a coercive force in excess of 3,440 Hc, the application of the magnetic field through the chain comprising shield 26, insert 28, pin 34, and insert 32, the magnetic polarization of magnet 46 cannot be reversed; therefore, the repulsive force existing between magnet 46 and pin 34 with the magnetic field from magnet 16 applied to lock mechanism 8 will remain a repulsive force and not become an attractive force, defeating the operability of the interlock.

Known materials which meet the requirements of having a coercive force in excess of 3,440 Hc are Samarium Cobalt and Neodymium. The preferred materials are Samarium Cobalt 16, Samarium Cobalt 18, Neodymium 27 and Neodymium 30 having coercive forces of 7,500 Hc, 8,000 Hc, 9,800 Hc and 10,000 Hc, respectively.

Choosing materials having a lower coercive force than 3,440 Hc may result in the reversal of the magnetic polarity of magnet 46 and may potentially result in an attractive force between magnet 46 and pin 34 sufficiently strong that the attack magnet 16 may not displace pin 34 toward insert 28. If the pin 34 is not displaced when the attack magnet 16 is placed in proximity of the stepper motor 14, the lock 8 may be successfully opened without benefit of entering the authorized combination.

While the illustrative values of the coercive force of the magnet 46 and the polarities of the magnet 46, insert 28 and pin 34 have been described, the design of a lock will dictate the minimum coercive strength value. Further, the orientation of the attack magnet 16 in the drawings is the only orientation of the magnet 16 that will displace the armature 15 of the stepper motor 14 in the necessary direction. A choice of a different stepper motor may require reversal of the attack magnet 16 and the polarity of all other parts and the magnet 46.

It is understood that minor changes and modifications may be made to the invention without departing from the scope of the invention as defined in the claims below.

We claim:

1. An anti-attack interlock mechanism comprising a housing;

a bolt slidably disposed within said housing for movement to an extended position and to a retracted position;

a magnetically actuable means for enabling retraction of said bolt;

means responsive to said magnetically actuable means for moving said bolt between said positions;

a recess disposed within said bolt and extending to a surface of said bolt slidably engaged with said housing;

a recess disposed in said housing aligned with said recess disposed within said bolt and extending to a surface of said housing in sliding engagement with said bolt;

a magnet disposed in said bolt recess;

a slidable interlocking member of a magnetically permeable material disposed within said bolt recess and axially aligned with said magnet;

a magnetically permeable focusing means for focusing magnetic flux disposed within said frame recess;

said recesses, said magnet, said focusing means and said interlocking member all oriented such that the axis of each is coaxial with the axis of the others when said bolt occupies a position extended from said retracted position sufficiently to secure a container to which said housing is attached;

whereby application of an attack magnet to said housing to magnetically affect said magnetically actuable means to permit withdrawal of said bolt from said extended position creates transient magnets of said focusing means and said interlocking member and thereby attracts said interlocking member into proximity of said focusing means to span said recesses preventing movement of said bolt to said retracted position and upon removal of said attack magnet said focusing means and said interlocking member cease to be transient magnets and said interlocking member is magnetically attracted to said magnet within said bolt recess restoring said interlocking member to an inoperative position.

2. The anti-attack interlock mechanism of claim 1 wherein said axes lie in a plane parallel to the axis of movement of said bolt and further lie to form an acute angle with the axis of movement from said extended position to said retracted position.

3. The mechanism of claim 1 wherein said interlocking member is provided with end surfaces oriented parallel to said surface of said bolt and said surface of said housing.

4. The mechanism of claim 3 wherein said focusing means is provided with one end surface oriented parallel to said surface of said housing and disposed recessed within said frame.

5. The mechanism of claim 4 wherein said magnet is constituted of a material with a coercive force greater than the maximum flux present at said magnet when said attach magnet is applied to said housing.

6. The mechanism of claim 1 further comprising a magnetically permeable shield at least partially surrounding said magnetically actuable means.

7. The mechanism of claim 4 further comprising a magnetically permeable shield at least partially surrounding said magnetically actuable means.

8. The mechanism of claim 6 further comprising a non-magnetic spacing means interposed between said magnet and said interlocking means.

9. A magnetic anti-attack interlock for a bolt lock having a magnetically affected enabling means for enabling said lock to open comprising:

a bolt;

a housing;

said bold disposed within said housing for movement to an extended position and to a retracted position;

a magnet having a north and south pole disposed within said bolt;

a magnetically attractable interlocking means held by said magnet in an ineffective position and displaceable from said magnet by a strong external magnetic field to a position bridging said bolt and said housing, thereby preventing withdrawal of said bolt to said ineffective position.

10. The magnetic anti-attack interlock of claim 9 whereby said magnet is fabricated of a material having a coercive force of at least 3,440 Oersteds.

11. The magnetic anti-attack interlock of claim 9 wherein said magnet is oriented to present to said interlocking means one of aid north and south poles, said one of said north and south poles chosen to act as a repelling pole in conjunction with a like north or south pole of said interlocking means when said interlocking means is transitorily magnetized by an external magnetic field.

* * * * *